US007311466B2

(12) United States Patent
Torvinen

(10) Patent No.: US 7,311,466 B2
(45) Date of Patent: Dec. 25, 2007

(54) APPARATUS AND METHOD FOR SUBGRADE PREPARATION

(75) Inventor: Jeffrey W Torvinen, South Range, MI (US)

(73) Assignee: Somero Enterprises, Inc., Jaffrey, NH (US)

( * ) Notice: Subject to any disclaimer, the term of this patent is extended or adjusted under 35 U.S.C. 154(b) by 64 days.

(21) Appl. No.: 11/175,469

(22) Filed: Jul. 6, 2005

(65) Prior Publication Data

US 2006/0008323 A1 Jan. 12, 2006

Related U.S. Application Data

(60) Provisional application No. 60/521,809, filed on Jul. 6, 2004.

(51) Int. Cl.
*E01C 19/22* (2006.01)

(52) U.S. Cl. ..... 404/118; 404/120

(58) Field of Classification Search ..... 404/118, 404/120, 106

See application file for complete search history.

(56) References Cited

U.S. PATENT DOCUMENTS 1,729,573 A * 9/1929 Finley ..... 404/75
1,782,707 A 11/1930 Bayley
2,094,910 A 10/1937 Bally
2,146,101 A 2/1939 Weber
2,306,671 A 12/1942 Tamblyn
2,322,365 A 6/1943 Jackson
2,346,379 A 4/1944 Jackson
2,358,085 A 9/1944 Millikin et al.
2,426,702 A 9/1947 Millikin et al.
2,473,961 A 6/1949 Mandt et al.
2,511,589 A 6/1950 Jaeger
2,746,366 A 5/1956 Reed (Continued)

FOREIGN PATENT DOCUMENTS

DE 25 55 216 A1 6/1977

(Continued)

OTHER PUBLICATIONS

SCRRR-EED™ concrete screed attachment by Van-Boh Systems, Inc. brochure, dated Jan. 1998.

(Continued)

*Primary Examiner*—Raymond W Addie
(74) *Attorney, Agent, or Firm*—Van Dyke, Gardner, Linn & Burkhart, LLP

(57) ABSTRACT

A subgrade preparation apparatus for preparing a subgrade surface for concrete to be placed thereon includes a base unit positionable on a support surface adjacent to a targeted subgrade area, an extendable boom extending from the base unit, and a subgrade head assembly adjustably mounted on the extendable boom. The subgrade head assembly includes a framework, a plow and a material moving device for moving material toward at least one side of the subgrade head assembly. The subgrade head assembly includes a plow end plate movably attached at an outer end of the plow and movable to a position where the plow end plate is generally vertical and forms an end portion of the plow to limit plowed material from flowing around the outer end of the plow as the subgrade head assembly is moved over and along the subgrade surface at the targeted subgrade area.

24 Claims, 6 Drawing Sheets

U.S. PATENT DOCUMENTS

| | | | | | |
|---|---|---|---|---|---|
| 2,947,230 | A | | 8/1960 | Heer et al. | |
| 3,041,946 | A | * | 7/1962 | Watters | 404/101 |
| 3,069,983 | A | | 12/1962 | Pizzarotti et al. | |
| 3,147,678 | A | | 9/1964 | Lewis | |
| 3,221,618 | A | | 12/1965 | Hudis | |
| 3,252,390 | A | | 5/1966 | Martinson | |
| 3,309,971 | A | | 3/1967 | Domenighetti | |
| 3,377,933 | A | | 4/1968 | Dale | |
| 3,412,658 | A | | 11/1968 | Griffin | |
| 3,429,381 | A | * | 2/1969 | Launder et al. | 172/815 |
| 3,435,740 | A | | 4/1969 | McGall | |
| 3,453,939 | A | | 7/1969 | Pollitz et al. | |
| 3,526,173 | A | | 9/1970 | Brandstetter et al. | |
| 3,533,337 | A | | 10/1970 | Swisher Jr. et al. | |
| 3,541,932 | A | | 11/1970 | Hodson | |
| 3,550,511 | A | | 12/1970 | Potts | |
| 3,602,115 | A | | 8/1971 | Hanson | |
| 3,604,325 | A | | 9/1971 | Borges | |
| 3,604,512 | A | | 9/1971 | Carter et al. | |
| 3,636,831 | A | * | 1/1972 | Davin et al. | 404/84.1 |
| 3,636,832 | A | | 1/1972 | Schrimper et al. | |
| 3,638,539 | A | | 2/1972 | Lewis | |
| 3,638,540 | A | | 2/1972 | Williams | |
| 3,779,662 | A | | 12/1973 | Smith | |
| 3,816,014 | A | | 6/1974 | Klopf | |
| 3,841,777 | A | | 10/1974 | Domenighetti | |
| 3,870,427 | A | | 3/1975 | Allen | |
| 3,873,226 | A | | 3/1975 | Teach | |
| 3,887,012 | A | | 6/1975 | Scholl et al. | |
| 3,907,451 | A | | 9/1975 | Fisher et al. | |
| 3,953,145 | A | | 4/1976 | Teach | |
| 3,970,405 | A | | 7/1976 | Swisher Jr. et al. | |
| 4,073,592 | A | | 2/1978 | Godberson et al. | |
| 4,162,708 | A | | 7/1979 | Johnson | |
| 4,273,196 | A | | 6/1981 | Etsusaki et al. | |
| 4,465,397 | A | | 8/1984 | Hollon et al. | |
| 4,466,757 | A | | 8/1984 | Allen | |
| 4,470,783 | A | | 9/1984 | Friebel et al. | |
| 4,493,585 | A | | 1/1985 | Axer | |
| 4,507,015 | A | | 3/1985 | Furukawa et al. | |
| 4,655,633 | A | | 4/1987 | Somero et al. | |
| 4,807,131 | A | | 2/1989 | Clegg | |
| 4,854,769 | A | | 8/1989 | Fukukawa et al. | |
| 4,861,189 | A | | 8/1989 | Fukukawa et al. | |
| 4,869,618 | A | * | 9/1989 | Morrison | 404/118 |
| 4,930,935 | A | | 6/1990 | Quenzi et al. | |
| 4,978,246 | A | | 12/1990 | Quenzi et al. | |
| 5,009,544 | A | | 4/1991 | Chaize | |
| 5,039,249 | A | | 8/1991 | Hansen | |
| 5,156,487 | A | | 10/1992 | Haid | |
| 5,201,604 | A | | 4/1993 | Ferguson et al. | |
| 5,222,829 | A | | 6/1993 | Mogler et al. | |
| 5,224,793 | A | | 7/1993 | De Pol et al. | |
| 5,258,961 | A | | 11/1993 | Sehr et al. | |
| 5,288,166 | A | | 2/1994 | Allen et al. | |
| 5,288,167 | A | | 2/1994 | Gaffard et al. | |
| 5,328,295 | A | | 7/1994 | Allen | |
| 5,356,238 | A | | 10/1994 | Musil et al. | |
| 5,549,412 | A | | 8/1996 | Malone | |
| 5,588,776 | A | | 12/1996 | Swisher, Jr. et al. | |
| 5,752,783 | A | | 5/1998 | Malone | |
| 5,771,978 | A | | 6/1998 | Davidson et al. | |
| 5,819,444 | A | * | 10/1998 | Desmarais | 37/281 |
| 6,152,647 | A | | 11/2000 | Tapio et al. | |
| 6,183,160 | B1 | | 2/2001 | Tapio et al. | |
| 6,227,761 | B1 | | 5/2001 | Kieranen et al. | |
| 6,283,225 | B1 | * | 9/2001 | Hermonson | 172/817 |
| 6,363,631 | B1 | * | 4/2002 | Cordingley | 37/280 |
| 6,447,204 | B1 | * | 9/2002 | McDonald | 404/118 |
| 2001/0018006 | A1 | | 8/2001 | Smith | |
| 2003/0161684 | A1 | * | 8/2003 | Quenzi | 404/75 |

FOREIGN PATENT DOCUMENTS

| | | |
|---|---|---|
| DE | 3623570 A1 | 1/1988 |
| EP | 0 102 060 A3 | 5/1985 |
| GB | 332662 | 7/1930 |
| GB | 909194 | 10/1962 |
| GB | 1182385 | 2/1970 |
| NL | 9401774 | 6/1996 |

OTHER PUBLICATIONS

Screeed King® TSK 308 brochure, published more than one year prior to the filing date of the present application.

"Are you tired of screeding concrete this way?", Screeed King® TSK 308 brochure, published more than one year prior to the filing date of the present application.

* cited by examiner

APPARATUS AND METHOD FOR SUBGRADE PREPARATION

CROSS REFERENCE TO RELATED APPLICATION

The present application claims benefit of U.S. provisional application Ser. No. 60/521,809, filed Jul. 6, 2004, which is hereby incorporated herein by reference in its entirety.

FIELD OF THE INVENTION

The present invention relates generally to surface leveling and grading devices and, more particularly, to a device which is adapted for use in grading and smoothing loose subgrade materials prior to the pouring and placement of uncured concrete in order to construct a concrete slab thereon.

BACKGROUND OF THE INVENTION

In the construction industry where on-grade concrete floors, slabs, parking areas, and/or driveways, for example, are to be poured, the subgrade materials should be properly prepared prior to pouring the concrete. Subgrade materials may vary considerably but typically are comprised of earth, dirt, sand, gravel, stone, dust, or combinations thereof. It is highly desirable to maintain the proper design thickness of the concrete over the entire area of the pour. Generally, the subgrade materials should be leveled and smoothed prior to the concrete being placed thereon. Undesired settling or cracking of the resulting concrete slab can be limited or substantially avoided through accurate placement and compaction of the subgrade materials.

A vertical cross-section of a concrete slab that is dimensionally too thick relative to the desired slab thickness specification can be typically identified as a waste of concrete material. Excess thickness areas in the concrete slab also add to construction costs where the actual volume of the concrete required to complete the job exceeds the mathematically estimated amounts. When this happens, the expected surface coverage in square feet or meters for a pre-estimated volume of concrete may fall short of design expectations. On the other hand, a concrete slab that is dimensionally too thin in vertical cross section in a given location reduces the total strength of the concrete in that area. Concrete that is too thin or otherwise variable in thickness as a result of improper subgrade preparation and quality may also readily promote uncontrolled cracking and eventual premature failure of the slab within its expected service life.

Accurate placement and compaction of the sub-grade materials is generally known to be a challenge even with the aid of skilled personnel using generally known measuring tools and equipment. The preparation of the concrete subgrade surface is typically a manual-labor intensive undertaking. Even when operator-controlled power equipment may be utilized to help level and smooth subgrade materials, variations in the elevation of the subgrade with respect to the finished surface of the concrete may be significant. Further efforts toward perfecting the subgrade materials quickly adds to the overall cost and time invested in preparing the subgrade. Such further expenditures of resources typically do not result in a proportional improvement in the final quality of the prepared subgrade.

Therefore, there is a need in the art for an apparatus and method for providing an accurate and substantially smooth subgrade surface for the support of a concrete slab, and more specifically, to promote an improvement toward consistent vertical cross-sectional thickness in finished concrete slabs and the like.

SUMMARY OF THE INVENTION

The present invention provides an apparatus and method for accurate grading, smoothing, leveling and/or screeding of a subgrade or subsurface prior to placing, leveling, and/or screeding uncured concrete to a desired thickness and elevation over the subgrade or subsurface. The apparatus and method of subgrade preparation is not necessarily limited to the pouring or placing of concrete onto the subgrade surface, but is also suitable for application to the pouring of other like curable or hardenable materials, such as asphalt, for example, or the like. Additionally, the apparatus and method is not limited only to applications on flat-work or substantially level concrete and like materials, but may also be suitable or applicable to contoured and three-dimensional surfaces, such as those found in parking lots, driveways, water drainage areas, and other multi-contoured concrete surface areas and the like.

The subgrade preparation apparatus of the present invention is operable to reach out and into a subgrade area from a support surface or level above and adjacent to the subgrade area. The support surface above the subgrade may correspond generally with the elevation of the final concrete surface of the concrete that is to be placed at the subgrade area. The subgrading apparatus is operable to smooth the subgrade surface to a desired grade so that the poured and cured concrete slab (that is poured over the subgrade surface and screeded and cured) will have a substantially consistent and uniform thickness and will be substantially uniformly supported on the subgrade once placed thereon.

According to an aspect of the present invention, a subgrade preparation apparatus is operable to establish a subgrade surface, such as by grading, leveling and/or compacting the subgrade surface, in preparation for receiving uncured concrete on the subgrade, in order to construct a concrete surface on the subgrade. The subgrade preparation apparatus includes a base unit, an extendable boom extending from the base unit, and a subgrade head assembly vertically adjustable on the extendable boom. The base unit is positionable on and/or adjacent to the subgrade surface being created. The subgrading head assembly is vertically adjustable and can be lowered onto the subgrade surface of the subgrade. The subgrade head assembly includes a framework, a plow or blade member, a means for moving material toward at least one side of the subgrade head assembly, and one or more plow end plate members movably attached to the end or ends of the main blade member. The plow end plate member or members is/are movable to a generally vertical orientation where the end plate is alongside the respective end of the plow to limit plowed material from flowing around the end of the plow during operation of the subgrade preparation apparatus.

The plow end plate may be generally pivotable about a horizontal axis or hinge at the respective end of the plow, such that the end plate may be pivoted downward and toward the subgrade surface or upward and away from engagement with subgrade surface. The subgrade head assembly may include a plow end plate member at each end of the plow. The plow end plate members may be arranged generally vertically and generally perpendicular to the main blade member, thus creating a type of box plow or U-shaped plow when both end plates are moved downward toward the subgrade surface. The plow end plate members thus may contain and carry plowed subgrade material, such as sand, dirt, stones, gravel, dust and the like, as the subgrading head assembly is moved over the subgrade surface. When the plow end plate members are no longer needed, they may be moved or pivoted upward so that they are no longer engaged with the subgrade material, whereby the components no longer contribute to create a box type plow.

The plow or blade member has at least one outer end which defines an outermost portion of the subgrade head assembly. The subgrade head assembly thus may be operable to grade, level, and/or smooth the subgrade surface as closely as possible to the edges of the desired work area for applications where the subgrade area is at least partially surrounded by already placed and cured concrete, such as in applications where a section of a concrete road or surface may be cut and removed, and then replaced by a pre-formed slab of concrete or the like after the subgrade surface at the removed section is prepared.

The subgrade head assembly may be rotatably attached to the support boom of the machine. An actuator, such as a hydraulic actuator, such as a hydraulic cylinder or the like, may be attached by its ends between a support housing assembly and a main cross support of the subgrade head assembly. As the hydraulic cylinder is controllably extended or retracted, the subgrade head assembly may be rotated either clockwise or counterclockwise about an axis of rotation at the end of the support boom that is substantially vertical with respect to the subgrade surface being leveled and smoothed. Additionally, the vertical axis of rotation of the subgrade head assembly may be offset to one side from the center or mid point of the main cross support. This offset geometry offers the operator of the machine improved visibility of the first and second ends of the subgrade engagement apparatus when the machine is under operation.

The means for moving material toward at least one side of the grading head assembly may include the subgrade head assembly and plow blade member being partially rotated at an angle with respect to the direction of travel of the head assembly while the plow blade member engages the subgrade material, thus allowing any excess material to move along the blade member and toward a side of the subgrade head assembly. Rotation of the subgrade head assembly may be accomplished through attachment of the subgrade head assembly to a vertical shaft adapted to receive a set of upper and lower low friction bearings. The respective bearings are in turn mounted within a support housing assembly. The support housing assembly serves as an attachment to the support boom.

Optionally, the means for moving material toward at least one side of the subgrade head assembly may include an auger or other device for engaging the subgrade materials and moving excess material to a side of the subgrade head assembly. Such additional means may also or otherwise include, but are not limited to, a continuous chain or belt with paddles or other members for engaging the subgrade and moving material therealong.

The subgrade preparation apparatus includes an elevation device which is operable to lower and raise the subgrade head assembly relative to the support boom and the base unit. The elevation device is operable to lower the subgrade head assembly a substantial amount to allow the subgrade head assembly to reach the subgrade surface below the anticipated concrete surface elevation and within the subgrade area being graded.

After the subgrade surface is prepared, the base machine or unit of the subgrade preparation apparatus may be quickly converted and then utilized as a concrete screeding apparatus by exchanging the subgrade apparatus portion or head assembly of the machine with a concrete screeding apparatus or head assembly. The concrete screeding head assembly may be vertically adjustable and pivotable relative to the support boom in a similar manner as the subgrade head assembly, and may be operable to compact and smooth and level and screed uncured concrete placed at the subgrade area that was previously prepared via use of the subgrade head assembly.

According to another aspect of the present invention, a method for leveling and substantially accurately grading and preparing a subgrade surface for receiving uncured concrete on the subgrade to create a concrete surface above the subgrade surface includes providing a subgrade preparation apparatus having a base unit and a subgrade head assembly. The base unit is positioned on or adjacent to the subgrade surface being prepared. The subgrade head assembly includes a plow which has opposite ends. The method includes vertically moving the subgrade head assembly relative to the extendable support boom into an area of the surface defining the subgrade, generally horizontally moving the subgrade head assembly along the subgrade surface, and substantially accurately grading and leveling the subgrade surface with the plow and at least one plow end plate member at at least one end of the plow. The plow end plate member is pivotable along an axis generally parallel to the subgrade surface being graded, and generally perpendicular to the longitudinal axis of the main plow.

According to yet another aspect of the present invention, a subgrade preparation apparatus for leveling and substantially accurately grading and preparing a subgrade surface for construction of a concrete slab on the subgrade above the subgrade surface includes a base unit, an extendable boom, a subgrade head assembly, a pair of spaced-apart actuators and a subgrade head assembly rotation device. The base unit is positionable on or adjacent to the subgrade surface that is to be graded. The extendable boom extends from the base unit and has the subgrade head assembly adjustably mounted on the extendable boom. The subgrade head assembly is vertically adjustable relative to the extendable boom so as to be lowerable into engagement with the material to be graded. The subgrade head assembly includes a framework and a plow, a means for moving material toward at least one side of the subgrade head assembly, and at least one plow end plate pivotally mounted to at least one of the ends of the plow for substantially accurate grading and leveling the subgrade surface. A pair of actuators are connected to the subgrade head assembly at spaced positions on the subgrade head assembly. The actuators are operable to extend and retract to vertically move the plow, means for moving material and the plow end plate or plates of the subgrade head assembly relative to the extendable boom and the base unit. The subgrade head assembly may be pivotally attached to the support boom and pivotable about an off centered pivot axis that is offset toward one end of the subgrade head assembly.

Therefore, the subgrade preparation apparatus of the present invention is operable to accurately grade and level a subgrade surface for receiving uncured concrete to create a concrete slab of substantially uniform thickness for a roadway, parking area, airport runway, or the like. The manual labor requirements for preparing the subgrade may be substantially reduced during the process of subgrade preparation by the subgrade preparation apparatus. In addition, a highly accurate and superior quality subgrade may be produced by the utilization of controls that may include laserguided elevation controls, and may optionally include three dimensional tracking and profiling or contouring control systems. Increased utilization of the base unit or machinery is provided by the ability to quickly and optionally adapt a base machine with first a subgrade head assembly, and upon completion of subgrade preparation, the subgrade head assembly may be readily and quickly removed, allowing the same base machine to be quickly and optionally adapted to accept a concrete screed head assembly, whereby the concrete screeding and leveling operations may then proceed toward the construction of a concrete slab of uniform thickness and quality using the accuracy, capabilities, and advantages of the machine as a whole.

These and other objects, advantages, purposes, and features of the present invention will become apparent upon review of the following specification in conjunction with the drawings.

DESCRIPTION OF THE PREFERRED EMBODIMENTS

Figure 1:
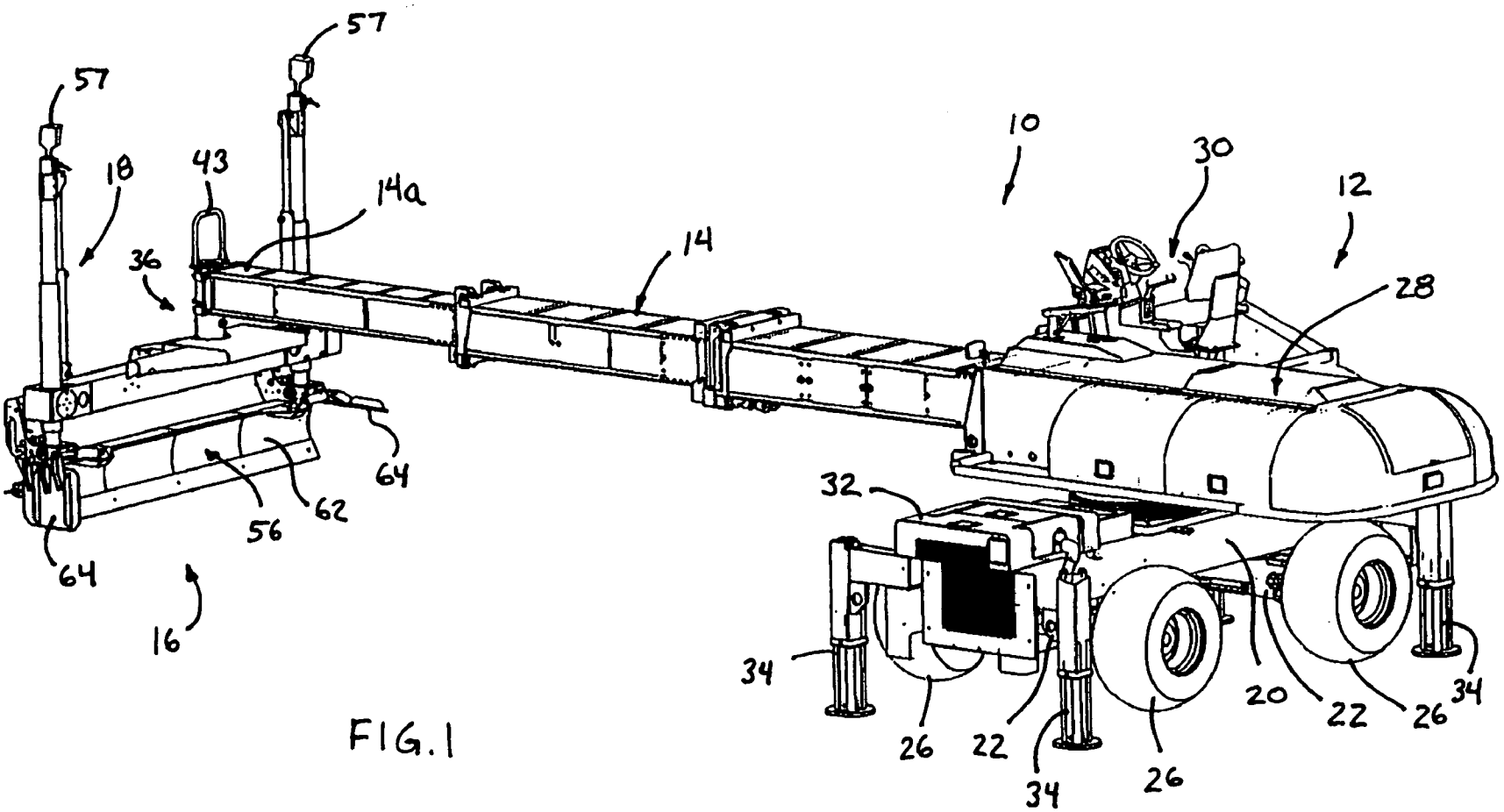
FIG. 1 is a perspective view of a subgrade preparation apparatus in accordance with the present invention.

Referring now to the drawings and the illustrative embodiments depicted therein, a subgrade preparation apparatus or machine or device or assembly 10 includes a wheeled base unit 12 and an extendable or telescoping boom assembly or support boom 14 that extends from base unit 12 (FIG. 1). A subgrade preparation head assembly 16 is adjustably mounted to the support boom 14, such as at an outer end 14*a* of the extendable/retractable support boom 14, and is vertically adjustable relative to outer end 14*a* of support boom 14 via an elevation assembly 18. The wheeled base unit 12 is movable over an existing concrete surface, such as a section of highway pavement, airport runway, or the like, and is positionable adjacent to a subgrade area having a subgrade surface or sub-surface. The subgrade material may comprise any type of subgrade material, such as, for example, sand, mixed soil or dirt, gravel, stones, dust and/or the like. The subgrade head assembly 16 is movable out over the subgrade via the extendable support boom 14 (as shown in FIG. 1) and then lowered down to the subgrade surface via the elevation assembly 18. The subgrade head assembly 16 is then moved over and along the subgrade surface via retraction of support boom 14, whereby subgrade head assembly 16 smoothes and compacts and levels the subgrade surface to the desired grade, as discussed below.

Wheeled base unit 12 and support boom assembly 14 of subgrade preparation apparatus 10 are substantially similar to the base unit and boom assembly of the types described in U.S. Pat. Nos. 4,653,633; 4,930,935; 6,183,160; 6,152,647; and/or 6,129,481, which are hereby incorporated herein by reference, such that a detailed discussion of the base unit 12 and boom assembly 14 will not be included herein. Briefly, as shown in FIG. 1, base unit 12 includes a lower support frame 20 having front and rear propulsion support axles 22, each of which may provide both propulsion and steering capability, four support wheels 26, preferably including rubber tires, and an upper frame 28, which is preferably rotatable on a bearing assembly (not shown) supported on lower frame 20 and includes an operator support platform 30. The lower support frame 20 of base unit 12 may include an engine/hydraulic pump compartment 32 for housing the power source for the apparatus. The wheels 26 on axles 22 are preferably individually powered by hydraulic motors or other means for independently driving the wheels 26 of base unit 12.

As described in U.S. Pat. No. 4,655,633, incorporated by reference above, a known or conventional internal combustion engine, such as a diesel or gasoline powered engine, or an electric motor or engine, or other power source (not shown) may be mounted within engine compartment 32. Preferably, the engine provides power to a variable displacement, hydraulic pump (also not shown), which is preferably load-sensing and draws and returns hydraulic fluid from a tank or reservoir (also not shown). The engine compartment 32 also houses a battery for starting the engine and providing power to the various electrical controls and various hydraulic system components.

The bearing assembly is substantially similar to that described in U.S. Pat. No. 4,655,633, the disclosure of which is hereby incorporated by reference herein, and is powered by an hydraulic rotation motor (not shown) which is operable to rotate the upper framework 28 with respect to the lower framework 20 through 360 degrees. Four extendable, telescoping stabilizer legs 34, one at each corner of lower support frame 20, and each including a ground engaging foot or plate, are extendable and retractable by separate hydraulic cylinders and may extend downwardly to engage the concrete surface or other support surface when the subgrade preparation apparatus 10 is positioned adjacent to the subgrade area. Extension of the legs 34 may lift or support the entire apparatus off the wheels and tires 26 as needed to provide a stabilized support platform during extension and retraction of boom assembly 14 and subgrade head assembly 16 and during preparation of the subgrade. Alternately, extension of legs 34 to support the entire apparatus may not require fully lifting the wheels and tires off the support surface, whereby substantial support may also be gained by having both the extension legs and tires remaining in firm contact with the surface. Upper frame 28 also provides support for the telescoping boom assembly 14.

Boom assembly 14 extends outwardly from upper frame portion 28 below the operator's platform 30 and is mounted for horizontal, telescoping extension and retraction on suitable bearings, as is described in U.S. Pat. No. 4,930,935, incorporated by reference above. Boom assembly 14 is extendable and retractable to move subgrade head assembly 16 away from the base unit 12, in order to position the subgrade head assembly 16 at an initial position at the subgrade surface and to move the subgrade head assembly over and along the subgrade surface (and toward the base unit 12) to smooth and prepare the surface as discussed below. Clearly, however, other support booms and/or means for movably supporting the subgrade head assembly over and along the subgrade may be implemented, without affecting the scope of the present invention.

Figures 2, 6:
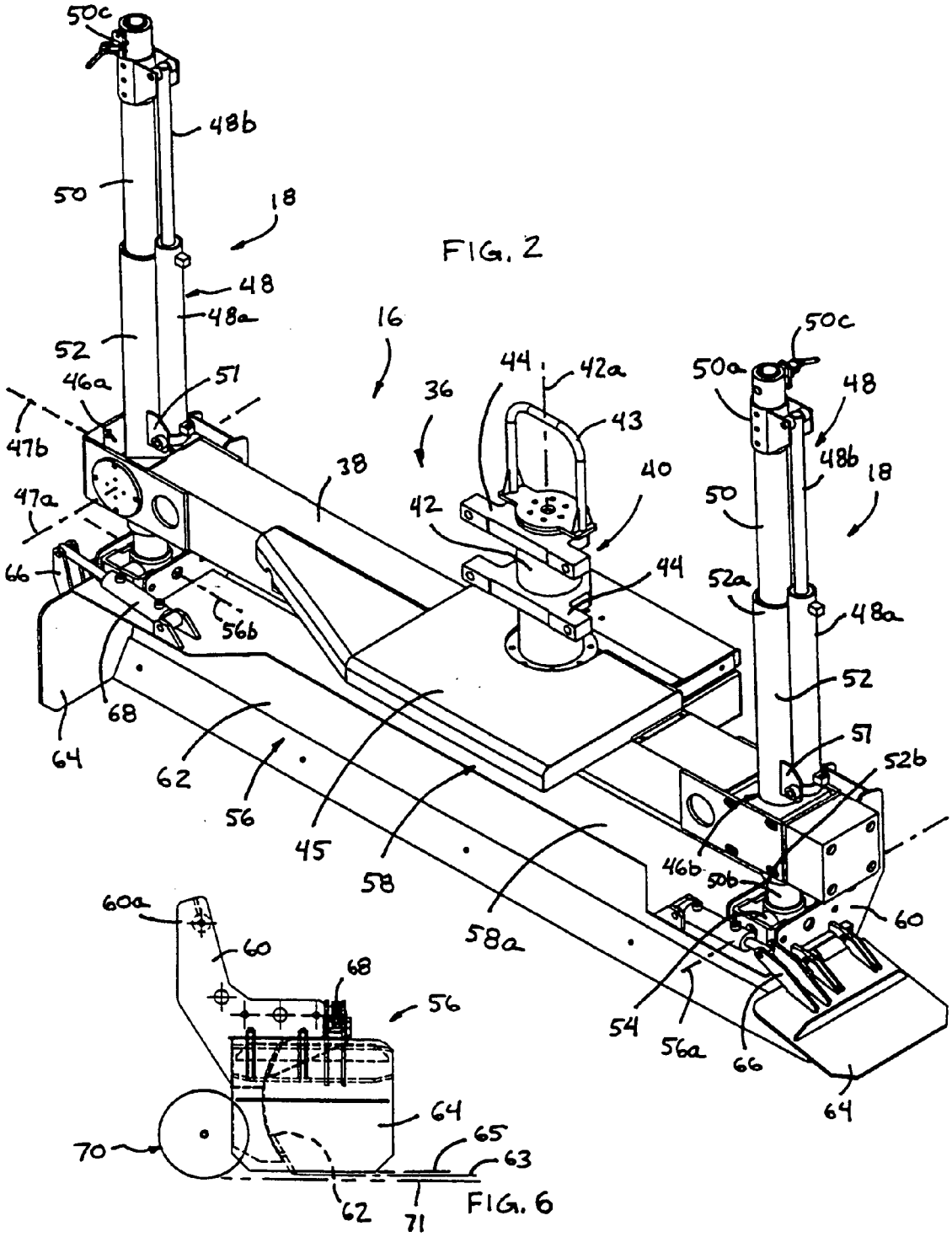
FIG. 2 is a perspective view of a subgrade preparation head assembly, as removed from the subgrade preparation apparatus.
FIG. 6 is a side elevation of the plow assembly of FIGS. 3-5.

As best shown in FIG. 2, subgrade head assembly 16 includes a mounting assembly 36 configured to attach to the outer, free end 14*a* of boom assembly 14, and has elevation assembly 18 attached thereto. A plow assembly 56 of subgrade head assembly 16 is, in turn, mounted to the lower ends of elevation assembly 18 and is vertically adjustable with respect to the subgrade and to boom assembly 14 and mounting assembly 36 via extension and retraction of elevation assembly 18. By means of the rotatable upper frame portion 28, boom assembly 14, which carries/supports mounting assembly 36, elevation assembly 18 and plow assembly 56 of subgrade head assembly 16, may be rotated 360 degrees around lower frame 20 of base unit 12 on the bearing assembly to swing or move the subgrade head assembly 16 over a targeted area for smoothing and/or grading and leveling, i.e., screeding, the subgrade or surface of the targeted area that is adjacent to the base unit 12 of the subgrade preparation apparatus 10.

As shown in FIG. 2, mounting assembly 36 includes a cross member 38 and a pivot mount 40 extending upward from cross member 38. Pivot mount 40 includes a generally cylindrical pivot member 42 and has a pair of mounting brackets 44 attached to pivot member 42. Mounting brackets 44 are configured to mount or attach to end 14*a* of support boom or boom assembly 14, such as via a plurality of fasteners or bolts (not shown), such as via a fastener or bolt received through an aperture at each end of each mounting bracket 44. Subgrade head assembly 16 may include a handle 43 at the mounting assembly 36 for an operator to grasp, such as in situations where the operator may have to climb onto the subgrade head assembly or support boom, such as to adjust the laser receivers 57 (discussed below) or the like. The handle 43 may also function as a sight for the operator (when seated at the operator seating area 30 of base unit 12) during operation of the apparatus, whereby the handle may rotate with the subgrade head assembly to indicate the degree of turning of the subgrade head assembly to the operator. It is further envisioned that the handle may assist an operator in aligning and attaching or detaching the subgrade head assembly, whereby the operator may grasp and pull or push at the handle during the alignment and attachment of the subgrade head assembly to the support boom and/or during the removal of the subgrade head assembly from the support boom.

Pivot mount 40 includes a lower pivot member (not shown) that is pivotally received in or connected to pivot member 42 and that is pivotable relative to pivot member 42 and brackets 44 (and thus relative to support boom 14 when the subgrade head assembly is mounted to the end of the support boom) via a pivot device (not shown). Cross member 38 is attached to the inner pivot member and is thus pivotable with the inner pivot member relative to the pivot member 42 and the support boom 14. The pivot device may include an actuator, such as a hydraulic actuator or the like, which is operable to cause relative rotation between the pivot member 42 and the lower pivot member to cause rotation of the cross member 38 relative to the support boom 14. The pivot device may include a hydraulic actuator or cylinder that imparts linear movement of a belt or chain or the like, which in turn imparts rotational or pivotal movement of the lower pivot member relative to the upper pivot member 42. Other means for imparting such relative pivotal movement between the pivot members may be implemented without affecting the scope of the present invention. The actuator and belt or chain and the other components of the pivot device may be housed at least partially within a housing 45 at the upper region of the cross member 38 to protect the actuator and other components from the elements.

As can be seen in FIGS. 1 and 2, the pivot member 42 is positioned off center or is offset toward one side of the cross member 38 so as to define a pivot axis 42*a* that is off centered or offset toward one side of the mounting assembly 36 and subgrade head assembly 16. The vertical axis of rotation of the subgrade head assembly thus may be offset to one side from the center or mid point of the main cross support. Such an offset geometry or mounting arrangement provides enhanced visibility of the ends of the subgrade head assembly to the driver or operator of the subgrade preparation machine 10 so that the operator can readily view the ends of the subgrade head assembly and the subgrade area in front of the machine as the support boom is extending the subgrade head assembly out to the desired initial position and pulling or moving the subgrade head assembly toward the base unit during operation of the subgrade preparation apparatus. Cross member 38 of mounting assembly 36 further includes a pair of brackets or elevation mounts 46*a*, 46*b* for mounting or attaching mounting assembly 36 to elevation assembly 18. As can be seen with reference to FIG. 2, one of the brackets 46*a* pivotally attaches one side of the elevation assembly at or near one end of the cross member 38, while the other bracket 46*b* generally fixedly or rigidly attaches the other side of the elevation assembly at or near the other end of the cross member 38.

The elevation device or assembly may include a pair of electromechanical linear actuators, or preferably, hydraulic cylinders having a cylinder and a piston rod extendable and retractable relative to the cylinder. The first end of the actuators may be attached to the main support or mounting assembly 36 of the subgrade head assembly, while the second end of the actuators may be attached to the vertically movable portion of the subgrade head assembly. This arrangement allows the vertically movable portion of the subgrade head assembly to be adjusted in height with respect the material being graded. As shown in FIG. 2, elevation assembly 18 comprises a pair of elevation actuators 48, such as hydraulic cylinders or the like, each of which is operable to vertically move or extend/retract an inner elevation tube or post or rod 50 relative to an outer elevation tube or post or cylinder 52, which is attached to the respective elevation mount 46*a*, 46*b* at cross member 38. In the illustrated embodiment, each hydraulic cylinder or actuator 48 includes an outer cylinder 48*a* and a piston rod 48*b* movable along and within cylinder 48*a*, such as in response to pressurized fluid from the pump at base unit 12. A lower end or portion of each cylinder 48*a* is mounted to a bracket 51 or otherwise generally fixed relative to the outer elevation tube 52, while the piston rod 48*b* is attached to the inner elevation tube 50, such as at an upper end 50*a* of elevation tube 50.

Outer elevation tubes 52 are mounted to a respective actuator mount or collar 46*a*, 46*b* of mounting assembly 36 such that the tubes 52 may be secured to mounting assembly 36. In the illustrated embodiment, the tube 52 attached to collar 46*a* may be pivotable about at least one generally horizontal axis 47*a*, 47*b* relative to cross member 38, while the tube 52 attached to the other collar 46*b* may be generally rigidly or fixedly attached to cross member 38. A lower end

50*b* of each inner tube 50 is secured to a mounting bracket 54 secured to or toward a respective end of a plow assembly 56 of subgrade head assembly 16, as discussed below. Inner tube 50 is substantially longer than outer tube 52, such that lower end 50*b* of inner tube 50 may extend from the lower end 52*b* of outer tube 52, while upper end 50*a* of inner tube 50 protrudes from the upper end 52*a* of outer tube 52. The length of inner tube 50 relative to outer tube 52 allows for significant extension and retraction of lower end 50*b* of inner tube 50 relative to outer tube 52, which results in significant lowering and raising of plow assembly 56 relative to boom assembly 14 and base unit 12, in response to pressurized hydraulic fluid within hydraulic cylinder or actuator 48. In the illustrated embodiment, elevation assembly 18 is operable to lower and raise the subgrade head assembly 16 significantly below or above the level of the existing concrete or subgrade which supports base unit 12. The machine thus is capable of reaching greater depths (and heights) if necessary, in order to keep the subgrade head assembly within the range of automatic adjustment by the control system. Optionally, the machine may adjust the stabilizers at the base of the machine to incline the support boom downward (and upward), if necessary, to achieve the desired depth (or height).

Therefore, the elevation assembly of the present invention may lower the subgrade head assembly to a subgrade surface well below the desired finished elevation of the concrete surface that is to be created. The depth of the subgrade surface is adjusted to correspond with the desired thickness of the concrete to be placed thereon.

Optionally, the elevation device or system may be operable in conjunction with a tilt limiting device or system (not shown) that limits or substantially precludes binding and/or mechanical damage of the elevation assembly during raising and lowering the subgrade head assembly. The tilt limiting system may limit vertical movement of one side of subgrade head assembly 16 relative to the other, such as by limiting extension or retraction of one extension actuator or cylinder relative to the other, in order to limit or substantially preclude excessive tilt or twist of the subgrade head assembly, which may further cause binding of the elevation cylinders and extension tubes.

Optionally, the elevation assembly 18 may be automatically vertically adjusted and controlled in response to a laser reference plane system, preferably using laser beacon receivers and a laser reference plane generator (not shown) that establishes a laser reference plane at the worksite, such as described in U.S. Pat. Nos. 4,655,644 and/or 4,930,935, which are hereby incorporated herein by reference. In such an application, a laser receiver 57 (FIG. 1) may be mounted above or near the upper end 50*a* of each of the inner tubes 50. The laser receivers may be mounted to the upper ends of posts or rods which are insertable within the upper ends 50*a* of inner tubes 50 and secured relative thereto via a pair of clamps 50*c* (FIG. 2). The rods and laser receivers thus may be vertically adjustable along and within the inner tubes 50 to set the laser receivers at an appropriate height above the upper ends 50*a* of inner tubes 50. Because the rods are secured to the tubes 50, the laser receivers 57 are vertically movable or adjustable with the tubes 50, such that the vertical position of the inner tubes 50 relative to the outer tubes or cylinders 52 and, thus, relative to boom assembly 14 and base unit 12, is adjustable in response to and for positioning with respect to the laser receivers and the laser reference plane.

Optionally, and preferably, the elevation device may be operable in response to a three dimensional profiler or contouring system, such as the type commercially available from Somero Enterprises, such as the type disclosed in U.S. Pat. No. 6,227,761, issued May 8, 2001 to Kieranen et al. and entitled APPARATUS AND METHOD FOR THREE DIMENSIONAL CONTOURING, which is hereby incorporated herein by reference. The laser leveling system and laser receivers may be replaced with such a system if desired. The automatic three dimensional profiler or contouring system may include at least one three dimensional laser tracking target (not shown) mounted to a portion of the elevation device and one sonic height sensor (not shown), such as the type commercially available from Somero Enterprises of Houghton, Mich., such as the type disclosed in U.S. Pat. No. 6,227,761, issued May 8, 2001 to Kieranen et al. and entitled APPARATUS AND METHOD FOR THREE DIMENSIONAL CONTOURING, which is hereby incorporated herein by reference.

The plow assembly 56 is thus vertically adjustable relative to mounting assembly 36 and is pivotally adjustable relative to support boom 14, so that the plow assembly 56 may be moved and controlled relative to the support boom 14 during subgrade preparation. Plow assembly 56 includes a framework or support structure 58 that pivotally mounts to brackets 54 at corresponding brackets 60. As shown in FIG. 2, brackets 60 of plow assembly 56 are pivotally mounted to brackets or collars 54 at lower ends 50*b* of inner tubes 50 of elevation assembly 18, such that plow assembly 56 is pivotable about a pair of generally horizontal and generally orthogonal pivot axes 56*a*, 56*b* relative to the elevation posts or tubes 50, 52.

Framework 58 includes a cross member or support 58*a* and brackets 60 at opposite ends of the cross member 58*a* and extending generally upwardly therefrom. A main plow or plow member or plow blade 62 is mounted to cross member 58*a* and extends downwardly therefrom and generally faces in the direction of the base unit 12 when subgrade head assembly 16 is mounted at the end 14*a* of support boom 14. Plow member 62 is curved and formed to engage and push the subgrade material in front of the plow as the subgrade head assembly is moved over and along the subgrade surface and toward the base unit 12. A pair of side plows or plow wings or plow end plates 64 are positioned at opposite ends of the plow 62 to contain the plowed material at the plow blade during operation of the subgrade preparation device, as discussed below.

Figure 3:
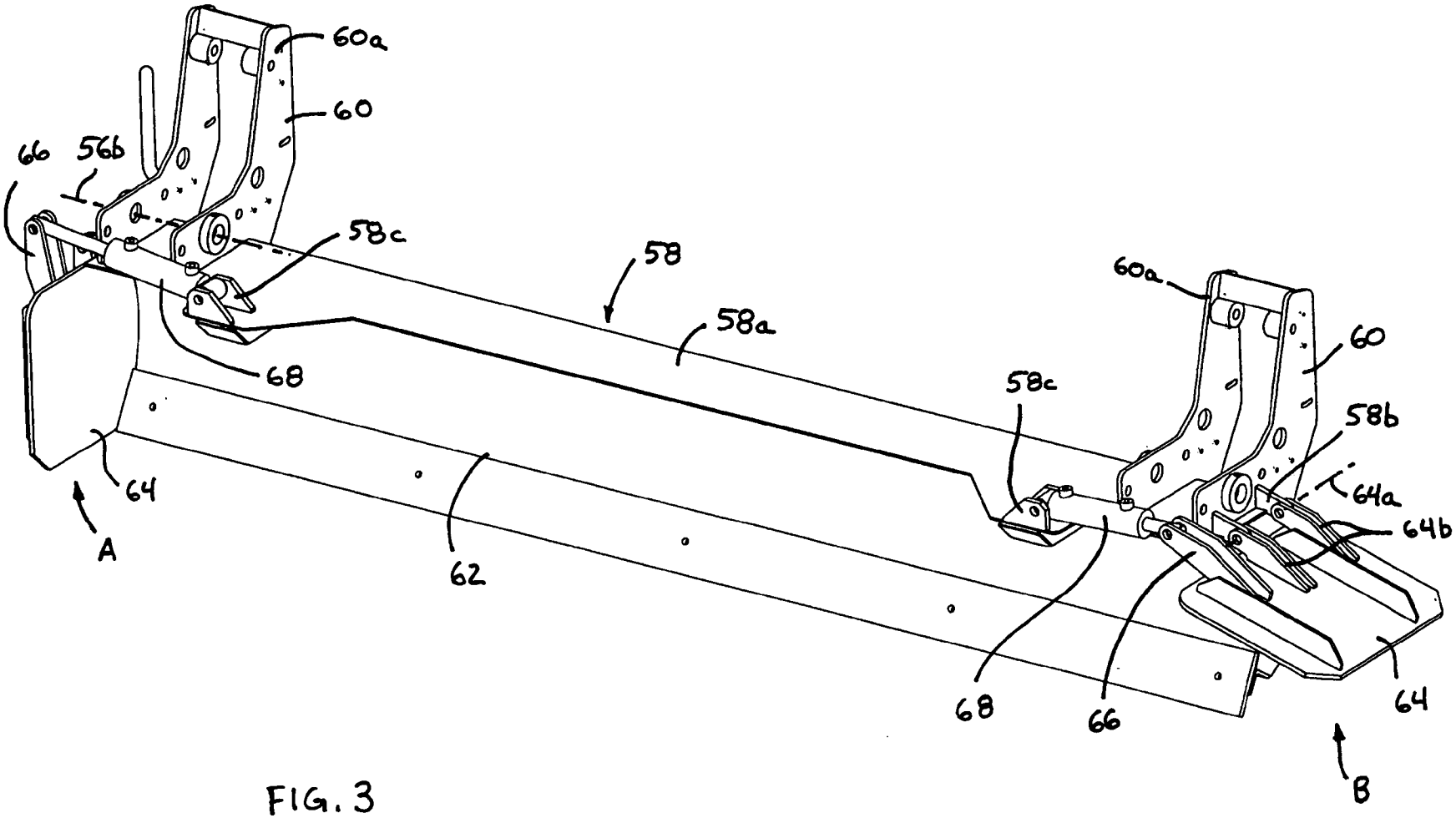
FIG. 3 is a perspective view of a plow assembly of the subgrade preparation head assembly of FIG. 2, showing a main or center plow and a pair of side plows or end plates.
Figure 5:
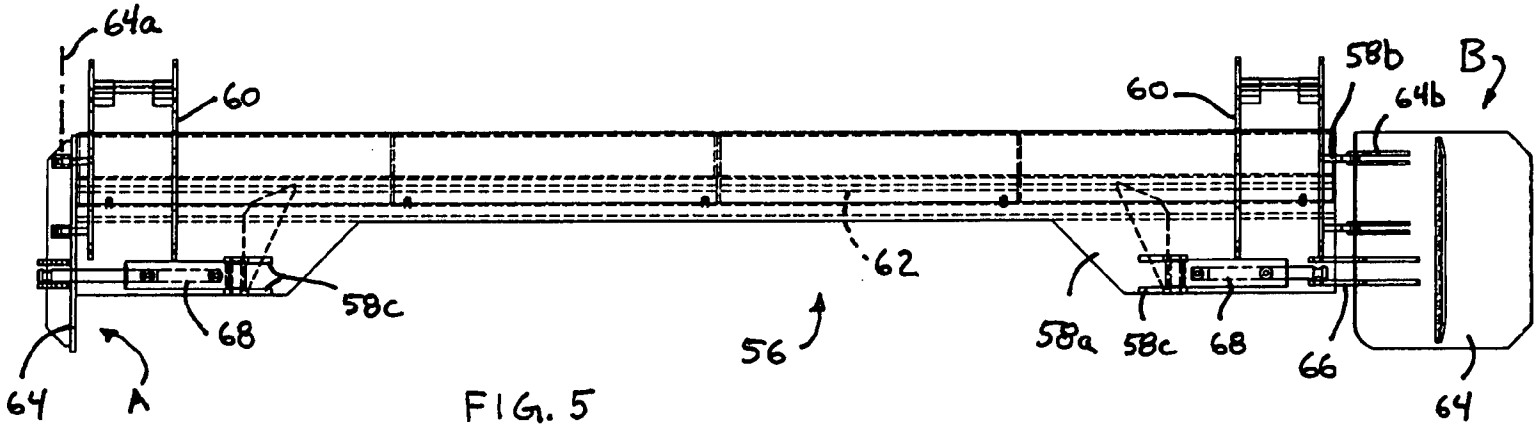
FIG. 5 is a top plan view of the plow assembly of FIGS. 3 and 4.
Figure 4:
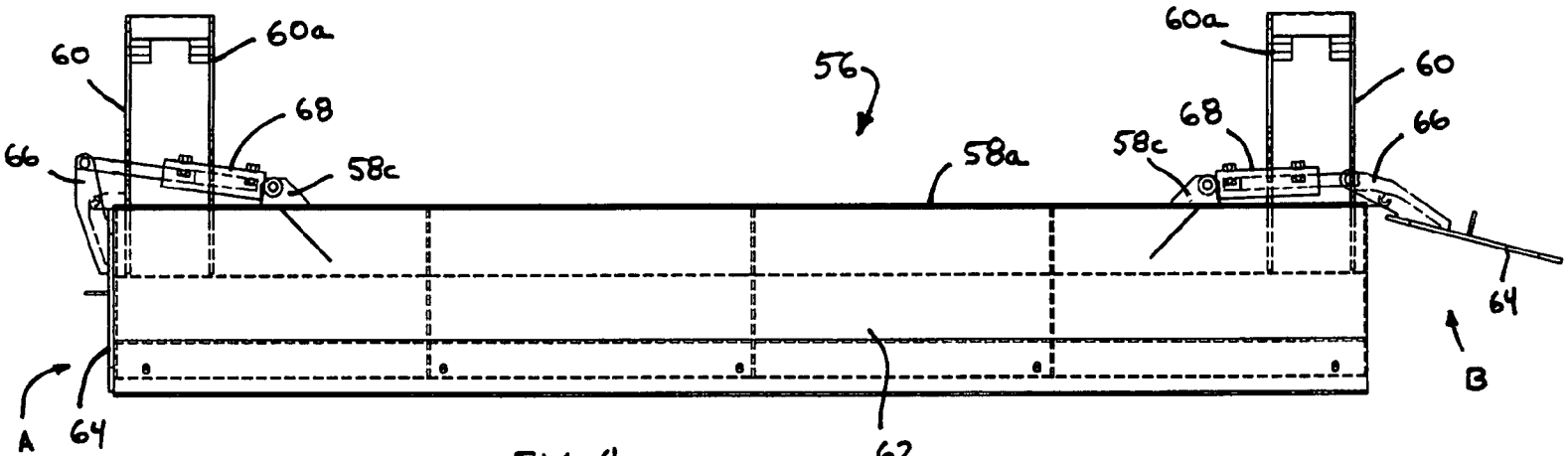
FIG. 4 is a front elevation of the plow assembly of FIG. 3.
Figure 7:
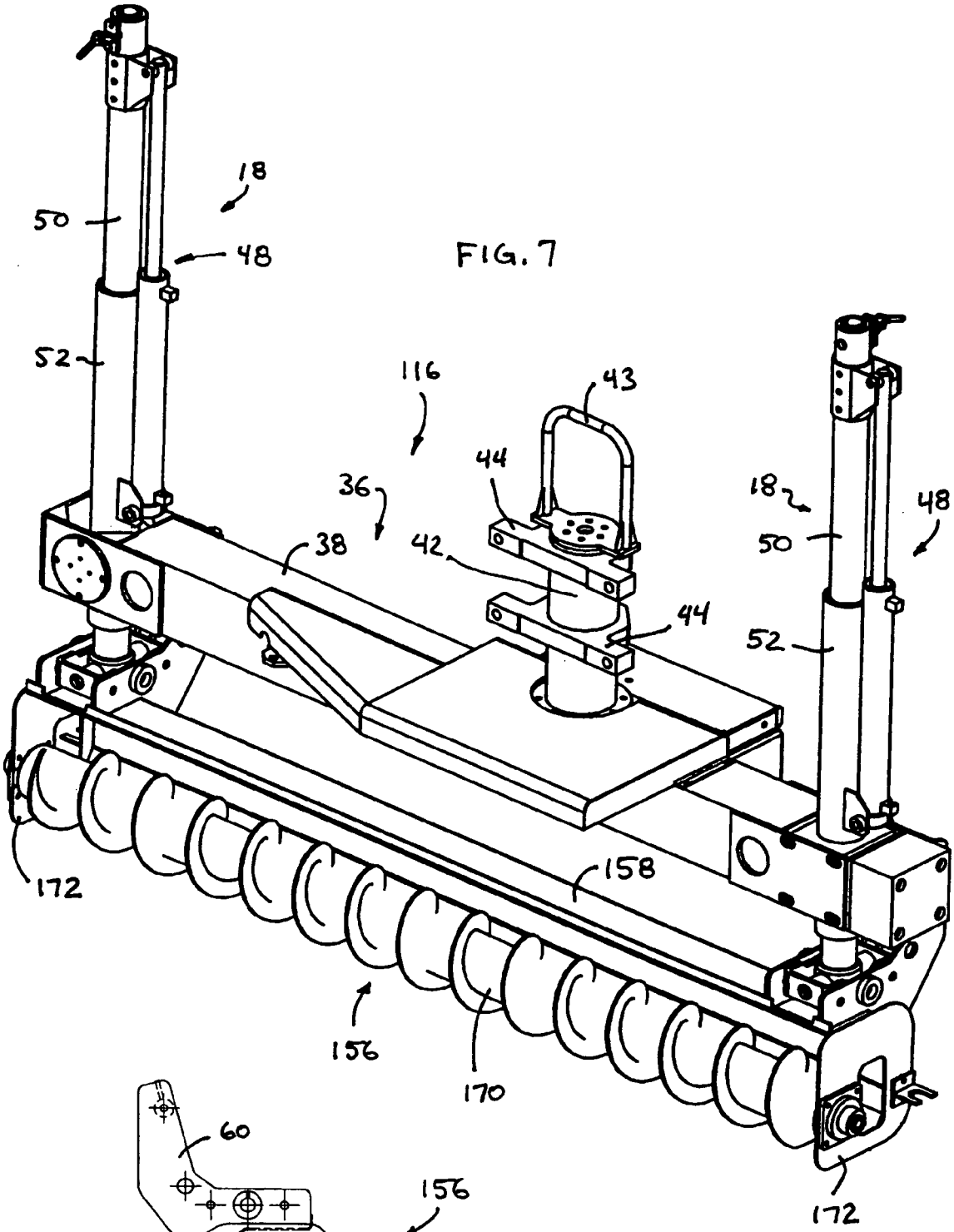
FIG. 7 is a perspective view of another subgrade preparation head assembly in accordance with the present invention.

The plow blade 62 is configured to engage and move or knock down any excess dirt or the like at the subgrade as the plow assembly is moved over and along the subgrade surface. In the illustrated embodiment, plow end plates 64 are pivotally mounted to support structure 58 and are pivotable about respective generally horizontal pivot axes 64*a* (FIGS. 3-5) that extend generally normal to the longitudinal axis of the plow. The plow end plates 64 are generally flat plates that extend generally orthogonally relative to the longitudinal axis of the plow blade 62 when the plow end plates 64 are pivoted to the lowered orientation alongside the main plow (as shown at A in FIG. 3). Each of the plow end plates 64 includes a bracket or brackets 64*b* for pivotally attaching the end plate to the support structure 58 (such as at corresponding brackets 58*b* extending from cross member 58*a*), and includes another bracket or arm 66 that extends from the end plate for attaching to an actuator 68, such as a hydraulic cylinder or the like, that is mounted to the support structure 58 (such as at a bracket 58*c* at cross member 58*a*). Arm 66 extends outward beyond the pivot axis 64*a* such that extension and retraction of actuator 68 causes pivotal movement of the respective plow end plate 64 about the pivot axis 64*a*.

The plow end plates 64 are thus pivotable between the lowered orientation A, where the plow end plate is positioned at and alongside the end of the plow, and a raised position or orientation B (FIGS. 3-5), where the plow end plate is pivoted upward from the end of the plow and removed from or spaced from the support surface. When in the lowered position or orientation A, the plow end plates or wings are positioned alongside the main plow such that the plow assembly forms a generally U-shaped plow for plowing the subgrade materials and retaining the plowed materials at the plow blade.

The plow end plates, when in the lowered position, thus retain the plowed materials at the plow and limit or substantially preclude the materials from flowing around the ends of the main plow as the plow is moved over and along the subgrade surface. When it is desired to release or dump the plowed materials, one or both of the plow end plates may be raised to allow the material to flow around the respective end or ends of the main plow. Optionally, the subgrade head assembly and plow assembly may be pivoted about the pivot axis 42*a* so that one end of the plow is a trailing end of the main plow (the trailing end of the plow is behind or trailing the leading end of the plow as the plow is moved over and along the subgrade surface and toward the base unit). The plow end plate at the trailing end may be selectively raised to allow the plow to release or dump the plowed materials at the trailing end as the plow is moved over and along the subgrade surface.

The plow end plates or plate members may be individually movable via respective actuators, such as hydraulic actuators, such as hydraulic cylinders or the like. However, other powered actuators, as well as manual actuation, may be employed to move the plow end plate members, without affecting the scope of the present invention. With the end plate members in the lowered position for engagement with the subgrade material, the box plow type arrangement provides an effective material engagement device for selectively carrying excess subgrade material across a surface to be leveled. Raising the plow end plate member or members during the grading process then may selectively release excess subgrade material at the desired end of the main blade member during the process of preparing the subgrade surface.

Subgrade head assembly 16 also includes a material moving device 70 (FIG. 6) which is operable to move subgrade material toward one or both sides of the plow assembly as the subgrade assembly is moved over and along the subgrade surface. The material moving device 70 may comprise an auger device that engages the subgrade surface and cuts and moves material from the surface to establish the desired grade of the subgrade surface as the subgrade head assembly is moved over the surface. The material moving device may be adjustably mounted to the subgrade head assembly, and may be adjustably mounted to the plow assembly 56 to allow for adjustment of a level of the material moving device relative to the level of the plow 62.

Material moving device or auger 70 is operable to engage the subgrade surface and cut or establish the level or grade of the subgrade surface as the subgrade head assembly 16 is moved along and over the subgrade. The auger assembly may include a spiraling or helical blade or flighting along a cylindrical portion, such that rotation of the auger assembly (such as via operation of a hydraulic motor or the like) causes the flighting to engage and cut at the subgrade surface and to move the subgrade material toward a side of the auger assembly. Suitable augers are described in U.S. Pat. Nos. 4,655,644 and/or 4,930,935, which are hereby incorporated herein by reference. However, the subgrade head assembly of the present invention may otherwise include other means for engaging the subgrade surface and cutting and/or moving excess material toward either side of the subgrade head assembly, without affecting the scope of the present invention. For example, the subgrade head assembly may include a continuous belt or chain which is movable and which has one or more paddles or extensions extending therefrom for engaging the subgrade surface and moving material toward one side of the subgrade head assembly, without affecting the scope of the present invention. Preferably, and as can be seen in FIG. 6, the components of the subgrade head assembly may be set relative to one another so that the level 71 of the material moving device or auger 70 is set to be slightly lower than the level 63 of the plow 62, which in turn is set to be slightly lower than the level 65 of the plow end plates 64.

The angle of attack of the plow assembly 56 (including the plow 62 and the material moving device 70) may be adjustable via an actuator or hydraulic cylinder (not shown) extending between an end 60*a* of bracket 60 at each end of plow assembly 56 and the end of the bracket 54 at each end of the plow assembly. Extension and retraction of the actuator may cause pivotal movement of bracket 60 (and thus of plow assembly 56) about pivot axis 56*b* to adjust the angle of attack of the plow assembly relative to the mounting assembly 36 and elevation device 18, in order to provide a desired or suitable angle of attack of the subgrade head assembly, depending on the particular application of the subgrade preparation apparatus.

Figure 10:
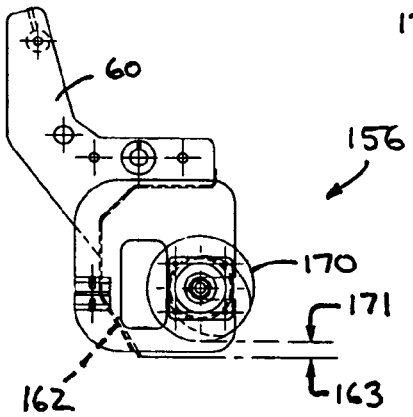
FIG. 10 is a side elevation of the plow assembly of FIGS. 8 and 9.
Figure 9:
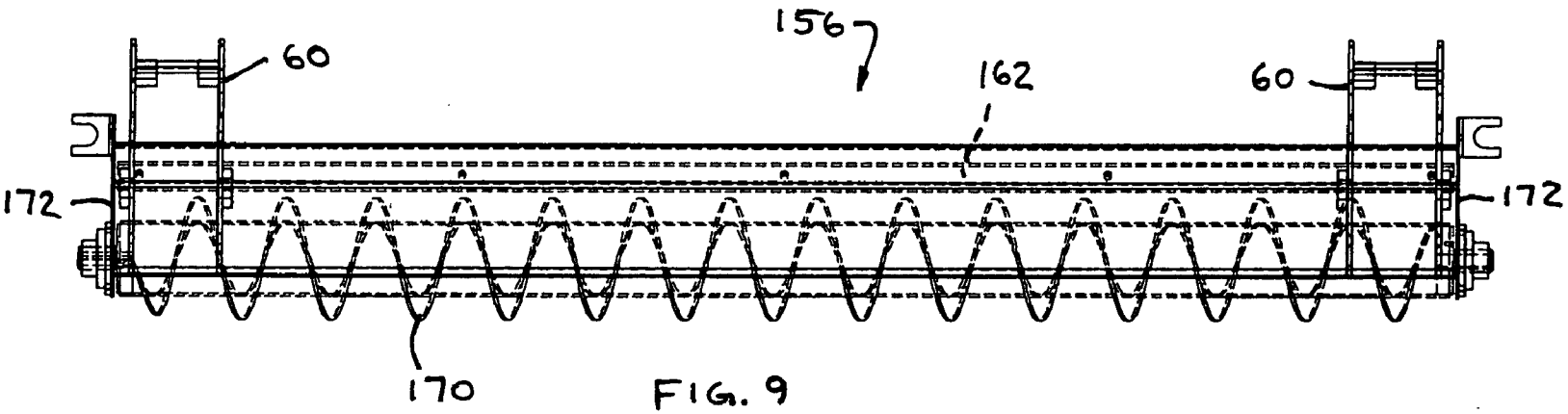
FIG. 9 is a top plan view of the plow assembly of FIG. 8.
Figure 8:
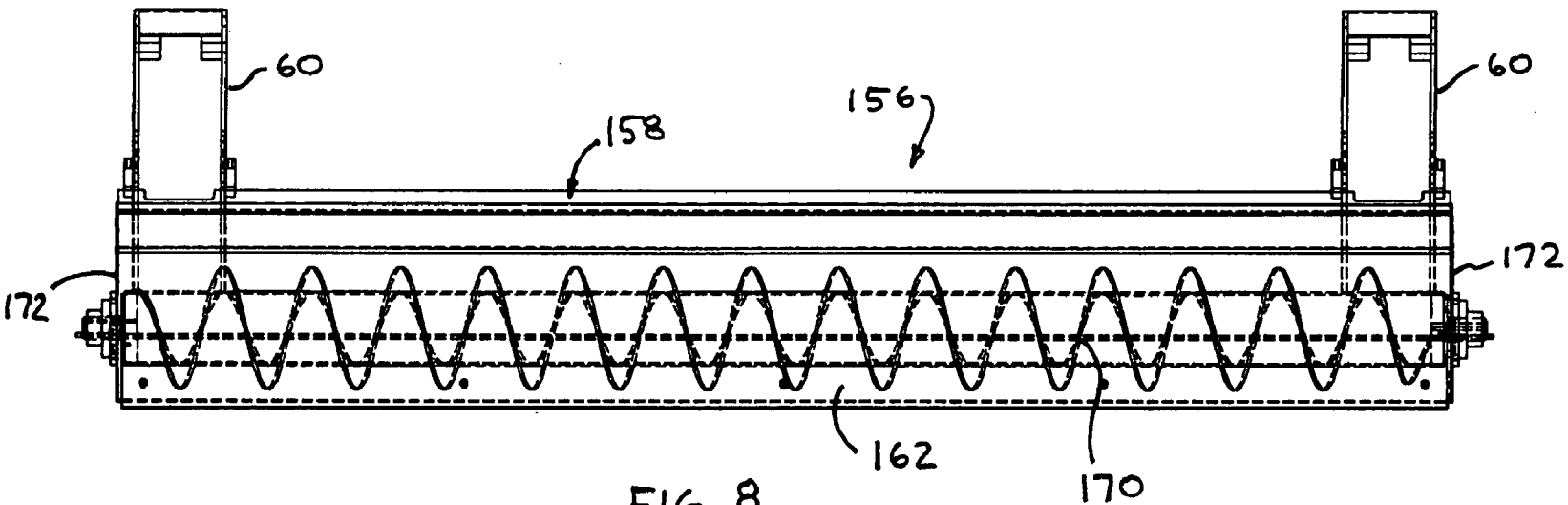
FIG. 8 is a front elevation of the plow assembly of the head assembly of FIG. 7.

Optionally, it is envisioned that the plow assembly may include a material moving device or auger that is mounted or positioned to be in front of the plow, without affecting the scope of the present invention. In such an application, the plow may be set to a lower level than the material moving device and the plow thus may function as the final grade setting device of the subgrade head assembly. For example, and with reference to FIGS. 7-10, a subgrade head assembly 116 may include a plow assembly 156 adjustably mounted to a support assembly 36 via elevation device 18 in a similar manner as described above. Subgrade head assembly 116 includes a material moving device 170 that is mounted to the plow assembly via end brackets 172 at opposite ends of the support structure or framework 158 and positioned forwardly of the plow 162. In the illustrated embodiment, the material moving device is an auger assembly that is rotatable to cut or establish the grade of the subgrade and to minimize the material that reaches the plow and thus that is carried by the plow as the subgrade head assembly moves over and along the subgrade surface. As shown in FIG. 10, the auger is set to establish the grade at a level 171 above the level 163 of the cutting edge of the plow 162, such as approximately 1½ inches above the level of the plow. The subgrade head assembly 116 may otherwise be substantially similar to the subgrade head assembly 16, described above, such that a detailed discussion of the subgrade head assemblies will not be repeated herein. The similar components are shown in the drawings of the subgrade head assemblies with like reference numbers.

The subgrade head assembly of the present invention is thus operable to smooth, accurately grade and level the subgrade surface to a desired grade, such that the subgrade will substantially uniformly support concrete placed thereon. This process results in a substantially smooth, even and level subgrade surface which substantially precludes cracking or breaking of the placed and cured concrete, which may otherwise result if it is unevenly supported by the subgrade. The subgrade head assembly is preferably of a dimensional width that facilitates access and maneuverability of the subgrade head assembly within various close proximity areas typically encountered at construction sites. Preferably, for example, the subgrade head assembly is only approximately eight and one half feet wide (2.59 meters) or thereabouts. However, other widths outside of this range are feasible as may be required or desired depending on the particular application of the subgrade head assembly, without affecting the scope of the present invention.

Optionally, the subgrade head assembly may include a vibrator or vibrating member (not shown) for engaging the subgrade surface to compact and smooth the surface as the subgrade head assembly is moved over and along the subgrade surface. The vibrator or vibrating member may include a motor that rotates a concentrically weighted shaft to cause vibration of a vibrating plate or contact plate that engages the subgrade surface. Such vibrating members are known, and an example of such a vibrating member is described in U.S. Pat. Nos. 4,653,633; 4,930,935; 6,129,481; 6,152,647; 6,183,160; 6,227,761; 6,588,976; and/or 6,623,208, which are hereby incorporated herein by reference. The vibrating contact plate engages the subgrade surface and vibrates to assist in compacting and smoothing the subgrade surface as the subgrade head assembly is moved along the subgrade surface by the boom assembly 14. The vibrating member may be positioned rearward of the material moving device and may be vibratable as it engages the subgrade surface to smooth and compact the cut and cleared surface. The level of the vibrating member or contact plate may be slightly below the level or grade established by the material moving device.

Optionally, it is envisioned that the subgrade head assembly may further include a tracing device or the like that is operable to generate a beam, such as a sonic tracing beam, downward along a side of the subgrade head assembly. The tracing device may detect the elevation of the finished or prepared surface of any previously prepared or accurately graded subgrade material such that a signal is sent to the elevation control system to establish matching of the current pass with any previously prepared material or surface area. Additionally, the tracing device may alternately be set to detect edge features or side walls of the cut out area (in other words, the existing concrete adjacent to the cut out area), so the operator of the subgrade preparation apparatus can be made aware of the location of the subgrade head assembly relative to the edge of the subgrade surface being prepared. This allows the operator to move the subgrade head assembly as close to the edge of the work area as possible to minimize the manual labor to clean up the edges of the subgrade.

Optionally, it is envisioned that the subgrade head assembly may be readily removed from the end 14*a* of support boom 14 to allow for a changeover of the machine from a subgrade preparation operation to a concrete screeding operation. For example, after the subgrade head assembly and subgrade preparation apparatus have completed the preparation of the subgrade surface, the subgrade head assembly may be removed from support boom 14, and a screed head assembly, which may include a plow, auger and/or vibrating device (such as the screeding devices described in U.S. Pat. Nos. 4,653,633; 4,930,935; 6,129,481; 6,152,647; 6,183,160; 6,588,976; and/or 6,623,208, which are hereby incorporated herein by reference), may be attached to end 14*a* of support boom 14, so that the machine may be used to compact and/or smooth and level and screed the uncured concrete that is placed at the prepared subgrade surface (or elsewhere if desired or applicable). In the illustrated embodiment, a plurality of fasteners, such as, for example, four sufficiently large threaded fasteners or bolts, are used to removably secure mounting brackets 44 (and thus the entire subgrade head assembly) to the support boom of the machine. The subgrade head assembly may then be removed from the support boom 14 and a screeding head assembly may be attached to the support boom of the same machine using the same large threaded fasteners (or similar fasteners).

After the subgrade surface is prepared, the same base machine or unit thus may be readily converted and then utilized as a concrete screeding apparatus by exchanging the subgrade apparatus or portion or head assembly of the machine or base unit with a concrete screeding apparatus or head assembly. Hydraulic quick-connect couplings may be provided to readily establish hydraulic fluid power to the hydraulic actuators and/or cylinders and/or motors of either optional attachment as needed. This provides the user of the machine to alternately adapt the machine to firstly grade and prepare an area of loose subgrade material and then, when this task is completed, to adapt the same machine to screed and smooth placed concrete as a second operation. This offers the operator of the machine greater utilization of the base machine and its attachments.

During operation of subgrade preparation apparatus 10, the base unit 12 may be driven on the existing concrete surface up to and substantially adjacent to the subgrade area. The stabilizers 34 may be lowered to engage the existing subgrade to stabilize subgrade preparation apparatus 10 during processing of the subgrade surface. Extendable boom 14 may then be extended outward from base unit 12 to move subgrade head assembly 16 a desired amount out over the subgrade area. The plow assembly 56 and material moving device 70 (and a vibratable member if applicable) may be lowered to engage the subgrade surface via the actuators 48 and support posts or tubes 50, 52. When the subgrade head assembly 16 is positioned at and over the desired starting area, the elevation actuators 48 are actuated to lower the plow assembly and material moving device down toward and into engagement with the subgrade surface of the subgrade area. In applications where there is existing concrete at least partially around the targeted subgrade area, the subgrade head assembly may be positioned for the first pass such that the subgrade head assembly and/or the plow wing or plate is/are positioned at or near or immediately adjacent to a wall or edge of an adjacent, already placed and cured concrete section.

Once engaged with the subgrade surface, subgrade head assembly 16 is operable to smooth and substantially accurately grade and level the subgrade surface to the desired elevation. The elevation actuators may be extended or pressurized to apply a desired amount of down pressure to the subgrade surface with the subgrade head assembly. The extendable boom 14 retracts to move the subgrade head assembly 16 over the subgrade surface as the plow and material moving device or auger engage and cut and/or smooth the surface. The plow is preferably positioned at a forward side of the subgrade head assembly 16 and functions to initially engage and move or knock down any excess dirt or the like at the subgrade surface as the subgrade head assembly 16 is moved along and over the subgrade surface.

The plow end plate or plates, when pivoted downwardly alongside the end or ends of the plow, function to retain the plowed material at the plow so that the plow carries the plowed material over and along the subgrade surface. For example, the generally U-shaped plow (formed by the main plow and one or both plow end plates) may carry approximately twelve cubic feet (approximately 0.34 cubic meters) of plowed material as the plow is moved over and along the subgrade surface. As the plow and subgrade head assembly approach the end of a pass of the subgrade head assembly, the plow end plate or plates may be pivoted upwardly to allow the plow to release the plowed material at the desired location or region or area. Optionally, the subgrade head assembly may be pivoted about the generally vertical pivot axis so that the plow is angled relative to the direction of travel of the plow, and the trailing or downstream plow end plate (the end plate at the end of the plow that trails the rest of the angled plow as the plow is moved over and along the subgrade surface) may be pivoted downward to retain the plowed material on the plow. The plow end plate at the leading end of the plow may also be pivoted downward or may be pivoted upward away from the subgrade surface as desired. When it is desired to release the plowed material from the plow, the trailing plow end plate may be raised to allow the plowed material to flow or dump off of the trailing end of the plow as the plow is moved further along the subgrade surface.

As the subgrade head assembly moves over the subgrade surface, the auger or other material moving device is activated to engage and cut the subgrade surface and to move any excess material toward one side of the subgrade head assembly 16 and otherwise fill in any low areas with excess material. Optionally, a vibrator or vibrating member may be positioned rearward of the material moving device and may be vibratable as it engages the subgrade surface to smooth and compact the cut and cleared surface. As the subgrade head assembly is moved along the subgrade surface, the elevation actuators may be automatically operable by the control system to maintain the subgrade head assembly at a desired grade in response to the laser leveling or three dimensional control system, such that the subgrade surface is compacted and smoothed to the desired grade over substantially the entire subgrade surface of the subgrade area.

After the extendable boom has moved the subgrade head assembly along the length of the subgrade area, the subgrade head assembly may be raised above the subgrade surface and the movable unit may be pivoted or moved to align the extendable boom for a second pass over an adjacent portion of the subgrade surface that is adjacent to, and preferably partially overlapping, the first compacted and smoothed area. This is where a tracing device may be optionally utilized to detect the elevation of the previously prepared or finished surface and provide substantially matching surface elevations between successive passes. The preparation process described above is then repeated until the subgrade surface of the targeted subgrade area is compacted and smoothed to the desired grade.

In applications where a final pass may be along a wall or edge of already placed and cured concrete, the subgrade head assembly may be positioned substantially immediately adjacent to the finished edge of the existing concrete to smooth the subgrade surface substantially up to the edge of the subgrade area. Preferably, the sides of the subgrade head assembly do not have any major projections projecting laterally outwardly therefrom, so that the ends of the plow or plow end plate may engage the subgrade surface substantially adjacent to the finished edge of the concrete at least partially along the subgrade area. Some minimal manual processing of the surface may be required along the outermost edges of the subgrade area to remove any excess material and smooth the areas where the subgrade head assembly of the present invention may not reach.

Therefore, the present invention provides a subgrade preparation device or apparatus which prepares a subgrade to a substantially level and smooth surface for receiving concrete thereon. The apparatus of the present invention is operable to lower a subgrade head assembly down into a subgrade area which may be several inches below the level at which the base unit of the apparatus is being supported. The apparatus is then operable to plow and grade the subgrade surface to a desired level in response to a laser reference plane (or other control system) so that the desired thickness of the concrete will result after the concrete has been placed and finished on the prepared subgrade surface. The apparatus of the present invention thus provides for enhanced smoothing, compacting, and/or substantially accurate grading of a subgrade surface that is substantially below a level of the concrete surface which supports the subgrade preparation apparatus. Either a flat laser plane reference or a pre-programmed three dimensional control system reference may be used to establish the elevation of the subgrade head assembly and therefore the accuracy of the finished grade.

Changes and modifications to the specifically described embodiments may be carried out without departing from the principles of the present invention, which is intended to be limited only by the scope of the appended claims as interpreted according to the principles of patent law.

The invention claimed is:

1. A subgrade preparation apparatus for leveling, grading and compacting a subgrade surface for receiving concrete thereon, said subgrade preparation apparatus comprising:

a base unit positionable on a support surface adjacent to a targeted subgrade area;

a support boom extending from said base unit; and a subgrade head assembly adjustably mounted on said support boom, said subgrade head assembly being vertically adjustable relative to said support boom to be lowered onto a subgrade surface at the targeted subgrade area, said subgrade head assembly including a framework, a plow and a material moving device for moving material toward at least one side of said subgrade head assembly for establishing the subgrade surface, said plow having a longitudinal axis and an outer end, said subgrade head assembly including a plow end plate pivotally attached at said outer end and pivotable about a generally horizontal pivot axis that is generally transverse to a longitudinal axis of said plow, said plow end plate being pivotable between a raised postion, where said plow end plate is generally horizontally oriented and generally transverse to said longitudinal axis of said plow, and a lowered position, where said plow end plate is generally vertical and is positioned at said outer end of said plow and generally transverse to said longitudinal axis of said plow to form an end portion of said plow to limit plowed material from flowing around said outer end of said plow as said subgrade head assembly is moved over and along the subgrade surface at the targeted subgrade area.

2. The subgrade preparation apparatus of claim 1 including first and second plow end plates pivotally mounted at respective ends of said main plow and pivotable about respective generally horizontal pivot axes.

3. The subgrade preparation apparatus of claim 1, wherein said material moving device comprises an auger having a longitudinal rotatable portion rotatably mounted to said subgrade head assembly.

4. The subgrade preparation apparatus of claim 1 including an elevation device which is operable to lower and raise said subgrade head assembly relative to said support boom and said base unit.

5. The subgrade preparation apparatus of claim 4, wherein said elevation device is operable in response to a laser reference plane and laser receivers mounted to a portion of said elevation device.

6. The subgrade preparation apparatus of claim 4, wherein said elevation device is operable in response to a three dimensional profiler or contouring system mounted to a portion of said elevation device.

7. The subgrade preparation apparatus of claim 1, wherein said subgrade head assembly is pivotally mounted to said support boom and is pivotable about a generally vertical axis.

8. The subgrade preparation apparatus of claim 7, wherein said generally vertical pivot axis is offset from a center of said subgrade head assembly and is positioned toward one end of said subgrade head assembly.

9. The subgrade preparation apparatus of claim 7, wherein said subgrade head assembly includes a mounting structure that is pivotally mounted to said support boom and wherein said plow, said material moving device and said plow end plate being vertically adjustable relative to said mounting structure via an elevation device.

10. The subgrade preparation apparatus of claim 9, wherein said material moving device is vertically adjustable relative to said plow.

11. The subgrade preparation apparatus of claim 1, wherein said subgrade head assembly is removably attached to said support boom and is removable therefrom, said support boom being configured to attach to a concrete screeding head assembly when said subgrade head assembly is removed therefrom.

12. A method for leveling, grading and/or compacting a subgrade surface for receiving concrete on the subgrade, said method comprising:

providing a subgrade preparation apparatus comprising a base unit positionable on a support surface and a subgrade head assembly having a plow which defines at least one end, said subgrade head assembly including a plow end plate movably mounted at said at least one end of said plow;

vertically moving said subgrade head assembly relative to said base unit onto a subgrade area;

pivoting said plow end plate about a generally horizontal pivot axis to move said plow end plate from a generally horizontal orientation to a generally vertical orientation along said end of said plow and generally transverse to a longitudinal axis of said plow;

generally horizontally moving said subgrade head assembly along the subgrade;

establishing the subgrade surface with said plow and a means for moving material to one side of said subgrade head assembly; and limiting movement of plowed material around said end of said plow by said generally vertically oriented plow end plate as said subgrade head assembly is moved over and along the subgrade surface.

13. The method of claim 12, wherein said subgrade head assembly includes a plow end plate that is pivotably mounted at each of said ends of said plow, and wherein said method comprises pivoting one of said plow end plates about a respective generally horizontal pivot axis to move said plow end plate to a generally vertical orientation along the respective end of said plow.

14. The method of claim 12 including pivoting said subgrade head assembly about a generally vertical pivot axis so that one end of said plow is a leading end and the other end of said plow is a trailing end as said subgrade head assembly is moved over and along the subgrade surface.

15. The method of claim 14, wherein said subgrade head assembly includes a plow end plate that is pivotably mounted at each of said ends of said plow, and wherein pivoting said plow end plate comprises pivoting said plow end plate about said generally horizontal pivot axis to move said plow end plate to said generally vertical orientation at said trailing end of said plow.

16. The method of claim 14, wherein said generally vertical pivot axis is spaced from a center of said subgrade head assembly and is positioned toward one end of said subgrade head assembly.

17. The method of claim 12, wherein vertically moving said subgrade head assembly includes vertically moving said subgrade head assembly in response to a laser reference plane and laser receivers mounted to a portion of said subgrade head assembly.

18. The method of claim 12, wherein vertically moving said subgrade head assembly includes vertically moving said subgrade head assembly in response to a three dimensional profiler or contouring system mounted to a portion of said subgrade head assembly.

19. The method of claim 12 including:

removing said subgrade head assembly from said subgrade preparation apparatus after preparation of the subgrade surface;

mounting a concrete screeding head assembly to said subgrade preparation apparatus; and screeding uncured concrete placed at the prepared subgrade surface.

20. A subgrade preparation head assembly configured to adjustably mount to a subgrade preparation apparatus for leveling, grading and compacting a targeted subgrade surface for receiving concrete thereon, said subgrade preparation head assembly comprising:

a framework;

a plow mounted to said framework, said plow having an outer end;

a material moving device mounted to said framework, said material moving device being operable to move material toward at least one side of said subgrade head assembly; and a plow end plate pivotally attached at said outer end of said plow and being pivotable about a generally horizontal pivot axis between a raised position, where said plow end plate is generally horizontally oriented, and a lowered position where said plow end plate is generally vertical and is positioned at said outer end of said plow and is generally transverse to the longitudinal direction of the plow so as to form an end portion of said plow to limit plowed material from flowing around said outer end of said plow as said subgrade head assembly is moved over and along the subgrade surface at the targeted subgrade area.

21. The subgrade preparation head assembly of claim 20 including first and second plow end plates movably mounted at respective ends of said plow and pivotable to said lowered position.

22. The subgrade preparation head assembly of claim 20 including an elevation device which is operable to lower and raise said framework relative to a support structure.

23. The subgrade preparation head assembly of claim 20, wherein said subgrade head assembly is pivotally mountable to a support structure and is pivotable about a generally vertical axis, said generally vertical pivot axis being offset from a center of said subgrade head assembly and positioned toward one end of said subgrade head assembly.

24. The subgrade preparation head assembly of claim 20, wherein said plow end plate is generally transverse to said longitudinal axis of said plow when in said raised position.

* * * * *